United States Patent [19]

Smith

[11] Patent Number: 4,889,662

[45] Date of Patent: Dec. 26, 1989

[54] MOTORLESS CARBONATOR

[75] Inventor: Ira A. Smith, Marietta, Ga.

[73] Assignee: The Coca-Cola Company, Atlanta, Ga.

[21] Appl. No.: 305,408

[22] Filed: Feb. 2, 1989

[51] Int. Cl.[4] ..... B01F 3/04

[52] U.S. Cl. ..... 261/35; 261/81; 261/82; 261/67; 261/DIG. 7

[58] Field of Search ..... 261/35, DIG. 7, 81, 261/82, 67

[56] References Cited

U.S. PATENT DOCUMENTS

| | | | |
|---|---|---|---|
| 613,376 | 11/1898 | Koenig et al. | 261/81 |
| 2,604,310 | 7/1952 | Brown | 261/82 |
| 3,323,783 | 6/1967 | Schwertfeger et al. | 261/81 |
| 3,756,576 | 9/1973 | Tremolada | 261/35 |
| 4,014,461 | 3/1977 | Harvill | 222/94 |
| 4,148,334 | 4/1979 | Richards | 261/DIG. 7 |
| 4,275,823 | 6/1981 | Credle, Jr. | 222/94 |
| 4,304,736 | 12/1981 | McMillin et al. | 261/DIG. 7 |
| 4,708,827 | 11/1987 | McMillin | 261/35 |
| 4,822,531 | 4/1989 | Rudick et al. | 261/82 |

*Primary Examiner*—Tim Miles

*Attorney, Agent, or Firm*—Birch, Stewart, Kolasch & Birch

[57] ABSTRACT

A motorless carbonator including a double acting diaphragm type pneumatic water pump is connected between a carbonator tank and a water supply. The pump is driven by the carbon dioxide fed to the carbonator tank. Control of the pump is by way of an electrically operated shut-off valve which is opened and closed in response to a water level sensor in the carbonator tank. Coupled between the carbonator tank and the pneumatic pump is a spring biased diaphragm valve assembly which is normally biased closed, but is opened when the pump is actuated to feed water into the carbonator tank.

9 Claims, 1 Drawing Sheet

MOTORLESS CARBONATOR

BACKGROUND OF THE INVENTION

This invention relates generally to carbonator apparatus utilized in post-mix beverage dispensing systems and more particularly to a pneumatically driven pump system for delivering water to a carbonator tank.

Various types of apparatus for making and dispensing carbonated water for a post-mix dispensing system are generally known. Such apparatus normally falls into two categories, one being a motor driven pump type carbonator assembly, while the other comprises a motorless or pneumatic pump driven assembly. In a motor driven carbonator, the water in a carbonator tank is mixed with carbon dioxide from a pressurized source and the water level in the tank is sensed and a pump motor is turned on and off to deliver water into the tank depending upon the sensed level. A motorless water delivery system uses a pneumatic pump, for example. It uses a double acting or a dual ended piston assembly which is reciprocated to pump water into the carbonator depending upon the level of the water present in the carbonator tank. In each instance, the carbonated water is then fed to a dispensing valve where the carbonated water is mixed with a measured amount of syrup concentrate to provide a carbonated beverage.

SUMMARY OF THE INVENTION

It is an object of the present invention, therefore, to provide an improved apparatus for making and dispensing carbonated water.

It is a further object of the invention to provide an improved apparatus for dispensing carbonated water in a post-mix beverage dispenser.

It is yet another object of the invention to provide an improvement in a motorless carbonator unit for a post-mix beverage dispenser.

And yet a further object of the invention is to provide an improvement in a carbonator for a carbonated beverage dispenser utilizing a pneumatically driven water pump.

The foregoing and other objects are realized by a motorless carbonator including a double acting diaphragm type pneumatic water pump connected between a carbonator tank and a water supply. The pump is driven by the carbon dioxide ($CO_2$) fed to the carbonator tank. ON/OFF control of the pump is by way of a $CO_2$ shut-off valve which is opened and closed in response to a water level sensor in the carbonator tank. Coupled between the carbonator tank and the pneumatic pump is a spring biased diaphragm valve assembly which is normally biased closed, but is opened when the pump is actuated to feed water into the carbonator tank. Water is mixed with the $CO_2$ by way of an atomizer in the carbonator tank and carbonated water accumulated in the tank is delivered to a dispensing valve assembly through a conduit which extends between the dispensing valve assembly and the carbonated water in the carbonator tank.

BRIEF DESCRIPTION OF THE DRAWING

A more complete understanding of the invention will be had by referring to the following detailed description when taken in conjunction with the accompanying drawing, wherein.

DETAILED DESCRIPTION OF THE INVENTION

Figure 1:
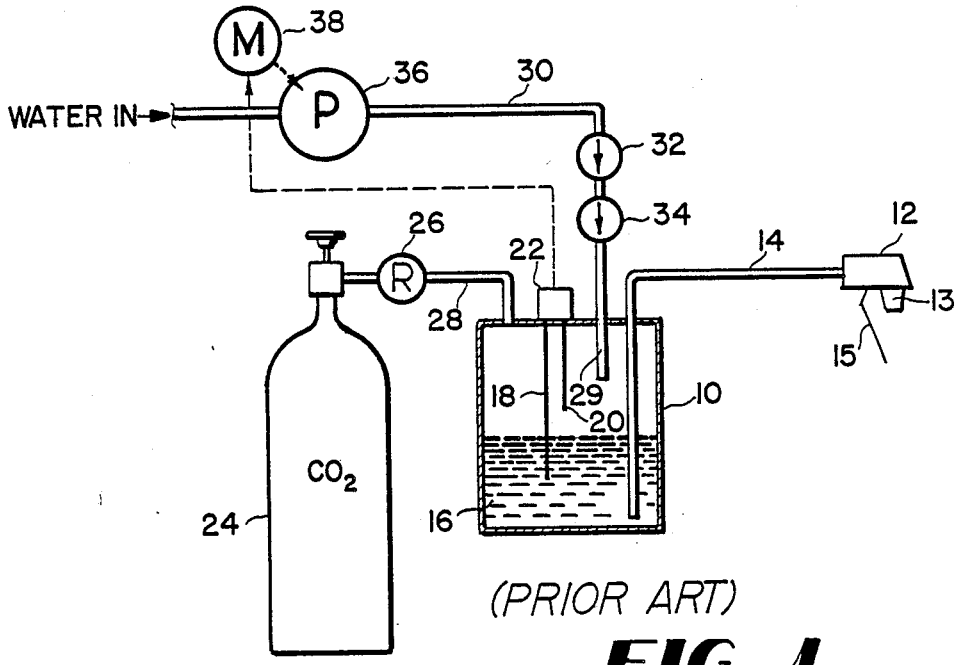
(PRIOR ART) FIG 1
FIG. 1 is a mechanical schematic diagram illustrative of a conventional carbonator including a motor driven water pump.

Referring now to the drawings wherein like reference numerals refer to like parts, and more particularly to FIG. 1, shown thereat is a schematic diagram which is illustrative of typical prior art apparatus for making carbonated water for use in a post-mix carbonated beverage dispensing system. The equipment utilized in making the carbonated water is generally known as a carbonator and, as noted above, is comprised of a unit including a motor driven water pump or a pneumatically driven water pump.

The configuration illustrated in FIG. 1 comprises the former type and is shown including a carbonator tank 10 which is connected to a dispensing valve assembly 12 through a pipe or a dip tube which extends down into a volume of carbonated water 16. The dispensing valve assembly is further shown including a mixing nozzle 13 and an actuating member 15. The level of the carbonated water 16 is measured by a sensing device shown comprising a pair of water level probes including a low level probe 18 and a high level probe 20 which operate an electrical switch 22. The probe 18 operates to close the switch 22 when the level of the carbonated water 16 falls below the lower end of the probe while the probe 20 operates to open the switch 22 when the level of the carbonated water 16 reaches the lower end of the probe 20.

The function of the carbonator tank 10 is to mix uncarbonated water with carbon dioxide ($CO_2$). As shown, $CO_2$ is supplied from a high pressure cylindrical tank 24 through a regulator 26 which reduces the $CO_2$ pressure to, for example, 100 psig. It should be noted, however, that the pressure can be adjusted to suit the taste of the user. $CO_2$ flows into the carbonator tank 10 via an input feed tube member 28. Uncarbonated water from a source, not shown, is fed into the carbonator tank 10 via an atomizer 29 coupled to the series connection of a delivery tube 30, a pair of check valves 32 and 34 and a motor driven pump 36. The pump 36 is driven, for example, by means of an electric motor 38 which is energized in accordance with the open or closed state of the switch 22.

Briefly, in operation, when the level of the carbonated water 16 falls below the low level probe 18, the switch 22 is closed which in turn causes the motor 38 to become energized. The pump 36 is actuated thereby and water is atomized into the tank 10 where it mixes with $CO_2$ and accumulates in the bottom, as shown by reference numeral 16, until it reaches the high level probe 20 which causes the switch 22 to open and accordingly shut off the motor 38. This action in turn causes the pump to stop pumping any further water into the tank 10.

Figure 2:
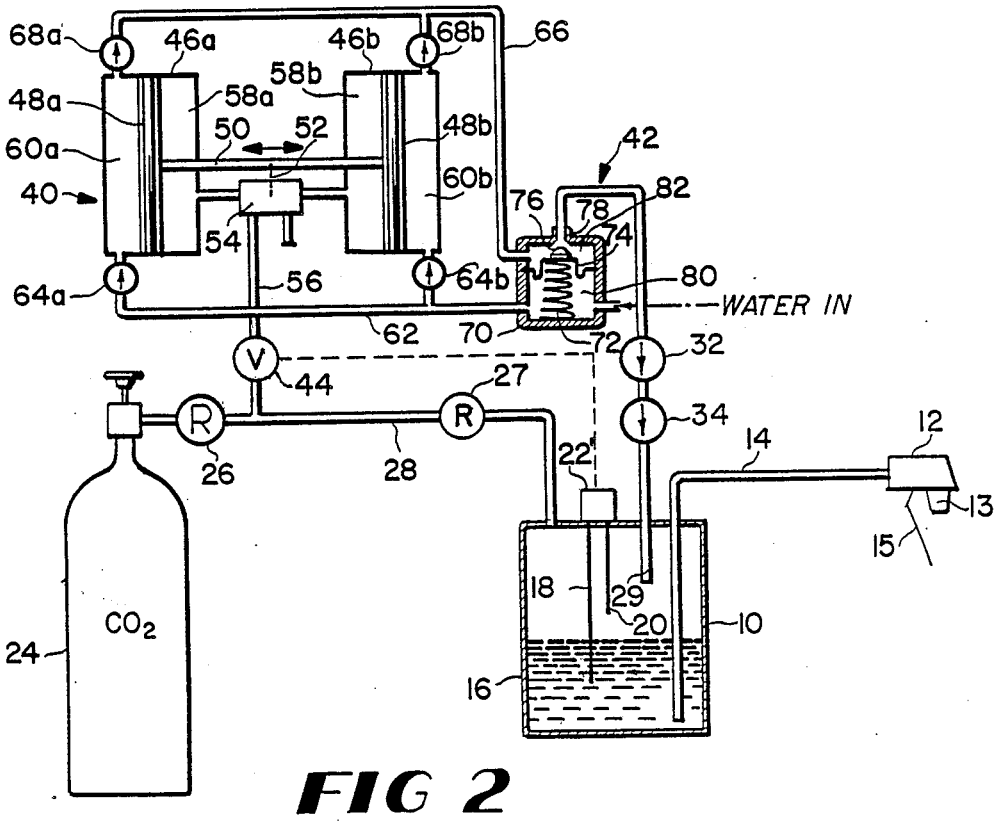
FIG. 2 is a mechanical schematic diagram illustrative of the preferred embodiment of the subject invention.

This now leads to consideration of the preferred embodiment of the invention which is shown schematically in FIG. 2. The embodiment of the invention shown in FIG. 2 comprises a motorless carbonator utilizing the same components insofar as the carbonator tank is concerned; however, the motor driven pump 36 is now replaced by a pneumatic pump 40 and an input-output water valve assembly 42. The pneumatic pump is driven by the $CO_2$ being fed into the carbonator tank 10 by way of an electrically actuated valve 44 which is coupled to and turned on and off by means of a switch device 22' which is activated in response to the water level of the carbonated water 16 as sensed by the low and high level probes 18 and 20, as before. However, a second pressure regulator 27 is inserted in $CO_2$ feed line 28. The regulator 27 is set at a lower pressure than that of regulator 26 in order to provide a relatively lower head space pressure to insure water flow into the carbonator tank 10 from the pneumatic pump 40.

The pneumatic pump 40 as shown in FIG. 2 comprises a double-acting type pump comprised of two identical cylinders **46*a* and 46*b* having respective flexible diaphragms 48*a* and 48*b* located therein. The diaphragms 48*a* and 48*b* are connected by a rod 50 to which is mechanically connected a valve reversing actuator 52 of a bistable control valve 54 and which is coupled to the $CO_2$ control valve 44 via a conduit 56. The bistable control valve 54 is pneumatically connected to the gas power chambers 58*a* and 58*b* which are alternately fed $CO_2$ therefrom depending upon the position of the valve reversing actuator 52. On the outside or opposite side of the diaphragms 48*a* and 48*b* there is located respective water pumping chambers 60*a* and 60*b*. Incoming water is fed to the water pumping chambers 60*a* and 60*b* by means of an input conduit 62 coupled to the water input-output valve 42 and one way check valves 64*a* and 64*b*. Water is pumped out of the chambers 60*a* and 60*b* at the top thereof and fed back to the valve assembly 42 by means of the conduit member 66 and one way check valves 68*a* and 68*b***.

Examples of a semi-automatic changeover valve and associated bag-in-box apparatus are described in U.S. Pat. No. 4,275,823 to William S. Credle and U.S. Pat. No. 4,014,461 to William A. Harvill, which are incorporated herein by reference.

Further as shown, the water input-output valve assembly 42 comprises a spring biased diaphragm type valve comprised of a housing 70 in which there is mounted a compression type bias spring 72 which is in contact with a flexible diaphragm member 74 having a valve member 76. The valve member 76 is normally biased against a valve seat 78 formed in the housing wall. An input water chamber 80 and an output water chamber 82 are provided on either side of the diaphragm member 74.

In operation, uncarbonated water from a source, not shown, is fed into the input chamber 80 containing the bias spring 72 where it is then fed to the conduit 62 connected to the water pump chambers **60*a* and 60*b* through the respective check valves 64*a* and 64*b*. When the level of the carbonated water 16 falls below a predetermined level, as sensed by the low level probe 18, the valve 44 is opened, causing $CO_2$ to be fed to the bistable control valve 54, where it is then fed to one of the gas powered chambers 58*a*, 58*b*, depending upon the position of the valve reversing actuator 52. The presence of the $CO_2$ in the gas powered chambers causes the respective diaphragm member 48*a* or 48*b* to flex toward the respective water pumping chamber 60*a* and 60*b* where water is forced out of the check valve 68*a* or 68*b* and into the output chamber 82 of the diaphragm valve by the tube 66. The pressurized water therein causes the valve member 76 to unseat and deliver water to the atomizer 29 in the carbonator tank via the delivery tube 30 and the check valves 32 and 34. When the connecting rod 50 moves to a predetermined position in either direction, the valve reversing actuator 52 causes the bistable control valve 54 to switch positions and $CO_2$ is fed into the other gas powered chamber, causing the respective diaphragm member to flex in the opposite direction. Thus a bistable pumping action of water into the carbonator tank 10 is effected, where it is atomized and mixed with the $CO_2$ fed thereto via the tube 28 from the tank 24. When the level of carbonated water 16 reaches the high level probe 20, the valve 44 is shut off, causing the pumping action to cease until such time that the water level again falls below the low level probe 18**.

While a complete post-mix carbonated drink dispenser is not shown, it will be appreciated that in addition to the carbonated water fed to the dispensing valve assembly 12 via the conduit 14, a measured quantity of concentrated syrup is also normally fed to the dispensing valve assembly 12 where it is mixed in the nozzle portion 13 when the lever member 15 is actuated by the abutment pressure of a receptacle, not shown.

Having thus shown and described what is at present considered to be the preferred embodiment of the invention, it should be noted that the same has been made by way of illustration and not limitation. Accordingly, all modifications, alterations and changes coming within the spirit and scope of the invention are herein meant to be included.

I claim:

1. A motorless carbonator comprising:

a closed container for mixing water and gaseous carbon dioxide to form carbonated water which is then accumulated in said container;

means for sensing the level of carbonated water in said container;

means for feeding carbon dioxide from an external source into said container;

a pneumatic water pump driven by carbon dioxide being fed to said container;

a carbon dioxide input control valve coupling carbon dioxide to said water pump and being operable in response to said level sensing means to activate and deactivate said water pump at predetermined sensed levels of carbonated water in said container; and a spring biased input-output water valve including a water input chamber and a water output chamber separated by a valve member, said water input chamber being coupled between a source of uncarbonated water and said water pump, said water output chamber being coupled between said water pump and said closed container, said water output chamber further including a valve seat therein, a bias spring located in said water input chamber, said valve member being normally biased against said valve seat by said bias spring to interrupt the flow of uncarbonated water to said container when said pump is inoperative but being forced open by water from said pump when operated to feed uncarbonated water into said container.

2. The carbonator as defined by claim 1 wherein said pneumatic water pump comprises a double acting pump including a pair of alternately operable water pumping sections each including a water pumping chamber and a gas power chamber separated by a pumping element;

a connecting rod coupled between said pumping elements;

a bistable control valve coupled to said carbon dioxide and having a valve reversing actuator coupled to said connecting rod to switch said control valve to opposite states in order to alternately feed carbon dioxide to said gas power chambers of said pumping sections to alternately pump input water from the respective pumping chambers.

3. A motorless carbonator for use in a post-mix carbonated beverage dispenser, for example, comprising:

a closed container for mixing water and gaseous carbon dioxide to form carbonated water which is then accumulated in said container;

means for sensing the level of carbonated water in said container;

means for feeding carbon dioxide from an external source into said container;

a double acting pneumatic water pump driven by carbon dioxide being fed to said container and including a pair of alternately operable water pumping sections each including a water pumping chamber and a gas power chamber separated by a pumping element;

a connecting rod coupled between said pumping elements;

a bistable control valve coupled to said carbon dioxide and having a valve reversing actuator coupled to said connecting rod to switch said control valve to opposite states in order to alternately feed carbon dioxide to of said gas power chambers of said pumping sections to alternately pump input water from the respective pumping chambers;

a carbon dioxide input control valve coupling carbon dioxide to said bistable control valve and being operable in response to said level sensing means to activate and deactivate said water pump at predetermined sensed levels of carbonated water in said container; and a spring biased input-output water valve including a water input chamber and a water output chamber separated by a valve member, said water input chamber being coupled between a source of uncarbonated water and said water pumping chambers, said water output chamber being coupled between said water pumping chambers and said closed container, said water output chamber further including a valve seat therein, a bias spring located in said water input chamber, said valve member being normally biased against said valve seat by said bias spring to interrupt the flow of uncarbonated water to said container when said pump is inoperative but being forced open by water from said pump when operated to feed uncarbonated water into said container.

4. The carbonator as defined by claim 3 wherein said closed container comprises a carbonator tank.

5. The carbonator as defined by claim 3 wherein each of said pumping elements comprise a flexible diaphragm.

6. The carbonator as defined by claim 5 and additionally including one-way check valves respectively coupled between each of the water pumping chambers and the water input chamber and between the water output chamber of said input-output water valve.

7. The carbonator as defined by claim 3 wherein said input-output water valve comprises a diaphragm valve.

8. The carbonator as defined by claim 3 wherein said valve member of said input-output water valve includes a flexible diaphragm separating said water input chamber and said water output chamber.

9. The carbonator as defined by claim 3 wherein each said pumping element includes a flexible diaphragm separating the water pumping chamber and the gas power chamber and wherein said valve member of said input-output water valve includes a flexible diaphragm separating said water input chamber and said water output chamber.

* * * * *

UNITED STATES PATENT AND TRADEMARK OFFICE

CERTIFICATE OF CORRECTION

PATENT NO. : 4,889,662

DATED : December 26, 1989

INVENTOR(S) : Ira A. Smith

It is certified that error appears in the above-identified patent and that said Letters Patent is hereby corrected as shown below:

In claim 3, line 26, after "to" delete "of".

Signed and Sealed this

Ninth Day of June, 1992

*Attest:*

*Attesting Officer*

DOUGLAS B. COMER

*Acting Commissioner of Patents and Trademarks*